US007580664B2

(12) United States Patent
Howe

(10) Patent No.: US 7,580,664 B2
(45) Date of Patent: Aug. 25, 2009

(54) SYSTEM AND METHOD FOR POSITIONING ONE OR MORE STRIPPER FINGERS (IN A FUSING SYSTEM) RELATIVE TO AN IMAGE

(75) Inventor: Richard L. Howe, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 190 days.

(21) Appl. No.: 11/807,817

(22) Filed: May 30, 2007

(65) Prior Publication Data

US 2008/0298861 A1 Dec. 4, 2008

(51) Int. Cl.
*G03G 15/20* (2006.01)
*G03G 15/14* (2006.01)

(52) U.S. Cl. ..... 399/323; 399/320; 399/399

(58) Field of Classification Search ..... 399/323, 399/322, 398, 399, 320, 400, 406; 271/307, 271/311, 10.16, 249
See application file for complete search history.

(56) References Cited

U.S. PATENT DOCUMENTS 4,168,902 A * 9/1979 Golz ..... 399/399
5,219,159 A 6/1993 Malachowski et al.
5,337,133 A 8/1994 Siegel et al.
5,493,634 A 2/1996 Bonk
5,794,176 A 8/1998 Milillo
5,822,668 A 10/1998 Fromm et al.
5,832,358 A 11/1998 Sampath et al.
6,738,518 B1 5/2004 Minka et al.
2002/0141792 A1 * 10/2002 Nakano et al. ..... 399/323
2006/0269332 A1 * 11/2006 Yamanaka et al. ..... 399/323

* cited by examiner

*Primary Examiner*—David M Gray
*Assistant Examiner*—Rodney Bonnette
(74) *Attorney, Agent, or Firm*—Gary B. Cohen

(57) ABSTRACT

A fuser stripping subsystem for use with a fusing system is provided. In one embodiment, at least one movable stripper finger is disposed adjacent a fusing assembly in a first position. Assuming a selected condition is met, the at least one movable stripper finger is moved from the first position to a second position for substantially aligning the at least one movable stripper finger with a toned image section of a print media sheet passing through a nip defined by the rolls. In another embodiment, a print media sheet with a toned image section is shifted, prior to feeding the same through the nip, so that the toned image section may be substantially aligned with at least one stripper finger. In yet another embodiment, a combination of stripper finger movement and/or image shifting may be used to obtain substantial alignment between one or more stripper fingers and an image.

22 Claims, 6 Drawing Sheets

SYSTEM AND METHOD FOR POSITIONING ONE OR MORE STRIPPER FINGERS (IN A FUSING SYSTEM) RELATIVE TO AN IMAGE

BACKGROUND

The disclosed embodiments relate to an approach for controlling the stripping of a print media sheet in a fusing system (including a fuser roll and a back-up roll), and, more particularly, to an approach for controlling the dynamic positioning of one or more stripper members relative to a print media sheet exiting the fuser or back-up roll.

The xerographic imaging process is initiated by charging a photoconductive member to a uniform potential. An electrostatic latent image, corresponding with a print job, is then selectively discharged on the surface of the photoconductive member. A developer material is then brought into contact with the surface of the photoconductor to transform the latent image into a visible reproduction. The developer material includes toner particles with an electrical polarity opposite that of the photoconductive member, causing them to be naturally drawn to it. A blank media sheet is brought into contact with the photoreceptor and the toner particles are transferred to the sheet by the electrostatic charge of the media sheet. The toned or developed image is permanently affixed to the media sheet by subsequent application of heat to the sheet. The photoconductive member is then cleaned to remove any charge and/or residual developing material from its surface to prepare the photoconductive member for subsequent imaging cycles.

One preferred fusing method is to provide a heated fuser roll in pressure contact with a back-up roll or biased web member to form a nip. A print media sheet is passed through the nip to fix or fuse the toner powder image on the sheet. In one common example, the heated roll is heated by applying power to a heating element located internally within the fuser roll that extends the width of the fuser roll. The heat from the lamp is transferred to the fuser roll surface along the fusing area. Quartz lamps have been preferred for the heating element.

U.S. Pat. No. 5,822,668 to Fromm et al., the pertinent portions of which are incorporated herein by reference, discloses a fusing subsystem for an electrophotographic printing system in which stripper fingers are shown as being positioned on the "downstream" side of a nip equivalent to the above-mentioned nip. In one known example, the stripper fingers gently strip a fused media sheet from the surface of the heated fuser roll. As taught by the '668 patent, several stripper fingers may be provided adjacent the fuser roll along its longitudinal axis, and each finger may be about 3 mm wide along the length of the fuser roll.

Generally, wax in the toner may be used to facilitate stripping of media for the fuser. This same wax may be used to provide lubrication between one or more stripper fingers and the fuser roll. This sort of lubrication can reduce wear imparted by the stripper fingers on the fuser roll. Avoiding this type of wear is highly desirable since such wear can result in observable print defects (gloss differential and/or poor fusing) and necessitate a replacement of the fuser roll (typically an expensive part). However, there is no guarantee that the toned areas of a media sheet passing through the fuser roll will line up with the stripper fingers in such a way that they are sufficiently lubricated. It would be desirable to provide an approach for ensuring appropriate alignment of stripper fingers and each toned media sheet passing through the fuser roll so that the stripper fingers are sufficiently lubricated and wear of the fuser roll is thereby substantially reduced.

SUMMARY

In accordance with one aspect of the disclosed embodiments there is provided a fuser stripping subsystem for use with a fusing system having a fuser roll and a back-up roll positioned to form a nip. The fuser stripping subsystem including: a movable stripping assembly selectively positioned adjacent to one of the fuser roll and back-up roll, said movable stripping assembly including at least one stripper finger, the at least one stripper finger being disposed in a first position and causing a portion of a print media sheet, having a toned image section disposed thereon, to be stripped from one of the fuser roll or back-up roll as the print media sheet with the toned image section passes through the nip; a drive mechanism, operatively coupled with said movable stripping assembly, for causing said movable stripping assembly to be moved from the first position to a second position when a selected condition is met, wherein the second position corresponds substantially with a location of the toned image section, relative to said movable stripping assembly, as the print media sheet passes through the nip; and a controller communicating with said drive mechanism, said controller (a) obtaining information regarding the location of the toned image section (b) determining a shift distance between the first position and the second position, and (c) causing said drive mechanism, with said shift distance, to move said movable stripping assembly from the first position to the second position when the selected condition is met so that the at least one stripper finger is substantially aligned with the toned image section before the lead edge of said media sheet arrives at said stripping assembly.

In accordance with another aspect of the disclosed embodiments there is provided a method of reducing wear in a fusing system including a fuser roll and a back-up roll positioned to form a nip, the fusing system being positioned adjacent a set of stripper fingers. The method includes: storing an electronic document including an electronic page, the electronic page corresponding with a print media sheet and including image information corresponding with at least one toned image section to be toned on the print media sheet; prior to imaging the print media sheet with the image information, determining a positional relationship between at least one of the set of stripper fingers and the image information on the electronic page; when the positional relationship varies from an accepted positional relationship by a selected amount, determining an amount of print media sheet shift required to obtain the positional relationship; and shifting the print media sheet with the at least one toned image section relative to the set of stripper fingers, said shifting causing the toned image section to be substantially aligned with at least one of the set of stripper fingers as the print media sheet is fed through the nip wherein the at least one of the set of stripper fingers is lubricated by contact with the at least one toned image section.

In accordance with yet another aspect of the disclosed embodiments there is provided a fuser stripping method for use with a fusing system having a fuser roll and a back-up roll positioned to form a nip. The method includes: (A) determining whether said method is to be performed in one of a first mode and a second mode; (B) performing the following when it is determined, with (A), that said method is to be performed in said first mode: (1) providing a movable stripping assembly selectively positioned adjacent one of the fuser roll and back-up roll, said movable stripping assembly including at least one stripper finger for causing a print media sheet, having a toned image section disposed thereon, to be stripped from one of the fuser roll or back-up roll as the print media sheet with the toned image section passes through the nip, (2) selectively positioning the at least one stripper finger in a first position, (3) determining a shift distance between the first position and a second position, the second position corresponding substantially with a location of the toned image section as the print media sheet passes through the nip, and (4) if a selected condition is met, moving the movable stripping assembly from the first position to the second position so that the at least one stripper finger is aligned with the toned image section; and (C) performing the following when it is determined, with said (A), that said method is to be performed in said second mode: (1) storing an electronic document including an electronic page, the electronic page corresponding with the print media sheet and including image information corresponding with the toned image section, (2) prior to imaging the print media sheet with the image information, determining a positional relationship between at least one of the set of stripper fingers and the image information on the electronic page, (3) when the positional relationship varies from an accepted positional relationship by a selected amount, determining an amount of print media sheet shift required to obtain the positional relationship, and (4) shifting the print media sheet with the at least one toned image section relative to the set of stripper fingers, said shifting causing the toned image section to be positioned in substantial alignment with the at least one of the set of stripper fingers as the print media sheet is fed through the nip so that the at least one of the set of stripper fingers is lubricated by contact with the at least one toned image section.

DESCRIPTION OF DISCLOSED EMBODIMENTS

Figure 1:
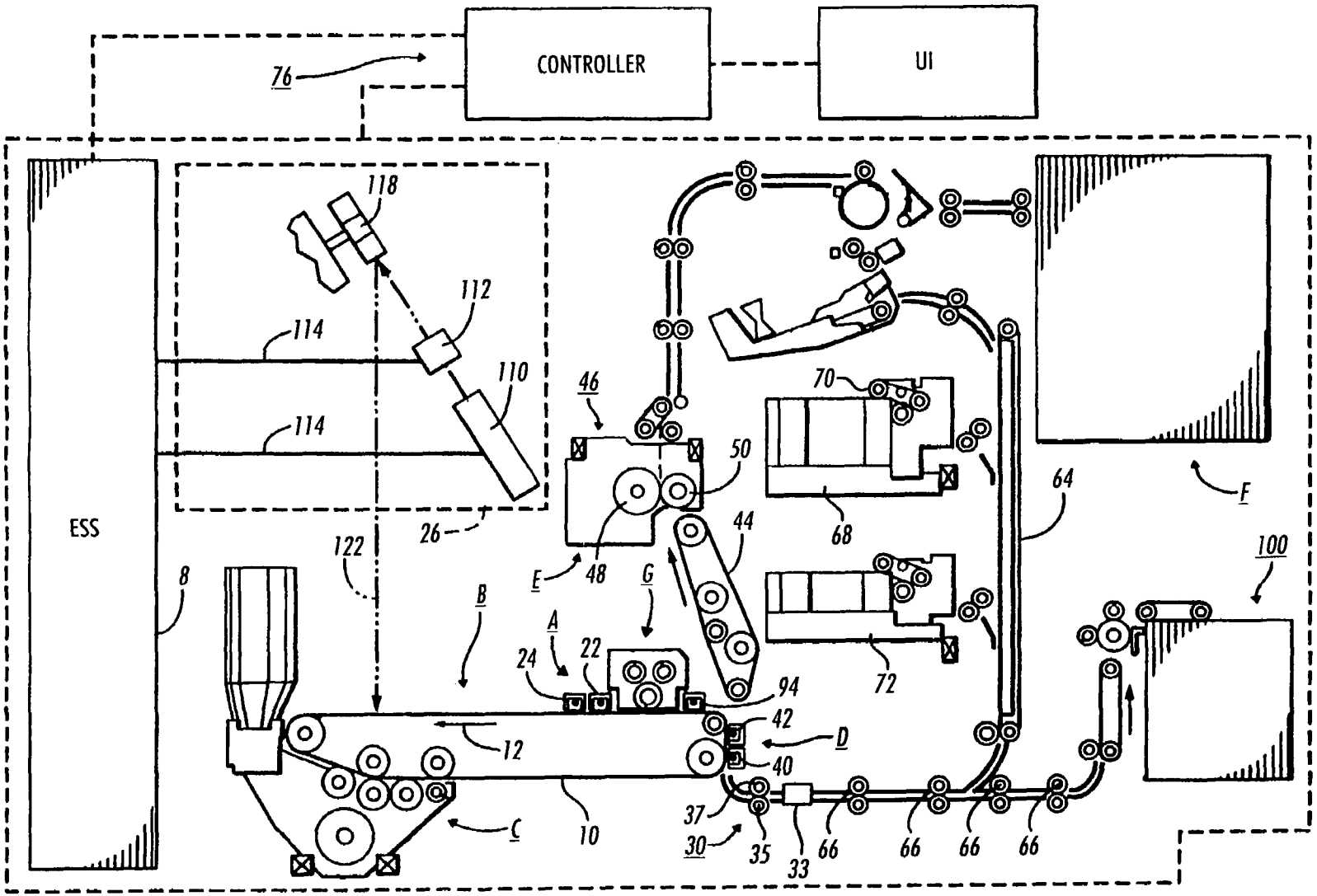
FIG. 1 is a schematic elevational view of a printing system including a contact fusing device having a heated fuser roll with a back-up roll.

Referring to FIG. 1 of the drawings, an electrophotographic printing machine, employing a photoconductive belt 10, is shown. Belt 10 moves in the direction of arrow 12 to advance successive portions sequentially through the various processing stations disposed about its path of movement.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At the imaging station, an imaging module indicated generally by the reference numeral 26, records an electrostatic latent image on the photoconductive surface of the belt 10. Imaging module 26 includes a raster output scanner (ROS). The ROS lays out the electrostatic latent image in a series of horizontal scan lines with each line having a specified number of pixels per inch.

In the disclosed embodiment of FIG. 1, the imaging module 26 (ROS) includes: a laser 110 for generating a collimated beam of monochromatic radiation 122; an electronic subsystem (ESS) 8, cooperating with the machine electronic printing controller 76 that transmits a set of signals via 114 corresponding to a series of pixels to the laser 110 and/or modulator 112; a modulator and beam shaping optics unit 112, which modulates the beam 122 in accordance with the image information received from the ESS 8; and a rotatable polygon 118 having mirror facets for sweep deflecting the beam 122 into raster scan lines which sequentially expose the surface of the belt 10 at imaging station B.

Thereafter, belt 10 advances the electrostatic latent image recorded thereon to a development station C. As is well known, the development station C includes a unit in which developer material (including toner particles and carrier granules) is housed. The latent image attracts toner particles from the carrier granules of the developer material to form a toner powder image on the photoconductive surface of belt 10. Belt 10 then advances the toner powder image to transfer station D.

At transfer station D, a print media sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the print media sheet to the proper magnitude and polarity so that the print media sheet is tacked to photoconductive belt 10 and the toner powder image attracted from the photoconductive belt to the print media sheet. After transfer, corona generator 42 charges the print media sheet to the opposite polarity to detack the print media sheet from belt 10. Conveyor 44 advances the print media sheet to fusing station E.

Fusing station E includes a fuser assembly indicated generally by the reference numeral 46. The fusing station causes the transferred toner powder image to be permanently affixed to the print media sheet. In one embodiment, fuser assembly 46 includes a heated fuser roller 48 and a pressure roller 50 with the powder image on the print media sheet contacting fuser roller 48. The pressure roller is cammed against the fuser roller to provide the necessary pressure to fix the toner powder image to the print media sheet. The fuser roll may be internally heated by a quartz lamp Print media sheets may be fed to transfer station D from the secondary tray 68. The secondary tray 68 includes an elevator driven by a bidirectional AC motor. Its controller has the ability to drive the tray up or down. When the tray is in the down position, stacks of print media sheets are loaded thereon or unloaded therefrom. In the up position, successive print media sheets may be fed therefrom by sheet feeder 70. Sheet feeder 70 is a friction retard feeder utilizing a feed belt and take-away rolls to advance successive print media sheets to transport 64 which advances the print media sheets to rolls 66 and then to transfer station D.

The print media sheet is registered just prior to entering transfer station D so that the sheet is aligned to receive the developed image thereon. In the present embodiment, the print media sheet is registered by way of a nonfixed edge registration device 30. A particularly effective device is shown and described in U.S. Pat. No. 5,219,159, the pertinent portions of which are incorporated herein by reference. This registration device utilizes a translating set of drive nips together with a stepper motor to accurately locate and position a registration edge. As will be described further, the registration position can be varied laterally with such a device to achieve the objectives of the disclosed embodiments. Alternatively, a registration device utilizing a laterally shiftable hard registration edge could also provide the necessary sheet offset.

Print media sheets may also be fed to transfer station D from the auxiliary tray 72. As contemplated in one embodiment, secondary tray 68 and auxiliary tray 72 are secondary sources of print media sheets, while a high capacity variable sheet size sheet feeder, indicated generally by the reference numeral 100, is the primary source of print media sheets.

Invariably, after the print media sheet is separated from the photoconductive belt 10, some residual particles remain adhering thereto. After transfer, photoconductive belt 10 passes beneath corona generating device 94 that charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at a conventional cleaning station G.

A generally conventional programmable controller 76 preferably controls, among other things, all xerographic imaging sheet feeding and finishing operations. The controller 76 is additionally programmed with certain novel functions and graphic user interface ("UI") features for the general operation of the above-described electrostatographic printing system. The controller 76 may include a known programmable microprocessor system, such as described in U.S. Pat. No. 5,832,358, the pertinent portions of which are incorporated herein by reference, for controlling the operation of all of the machine steps and processes described herein. Thus, for example, when the operator selects the finishing mode, either an adhesive binding apparatus and/or a stapling apparatus will be energized and the gates will be oriented so as to advance either the simplex or duplex copy sheets to finishing station F.

Figure 2:
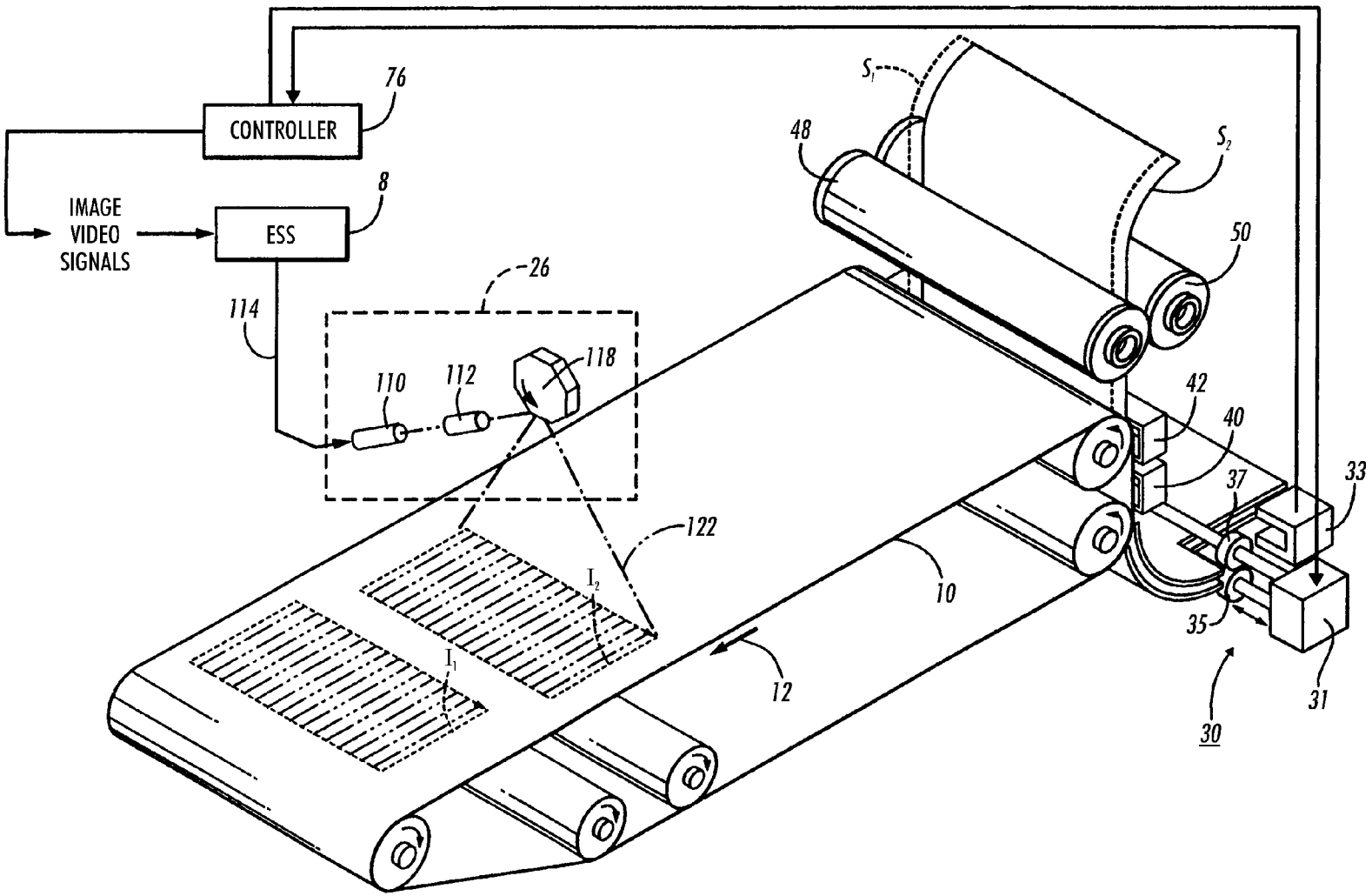
FIG. 2 is a perspective view of some components of FIG. 1.

Turning now to FIG. 2, a perspective view of some of the principal components of FIG. 1 is provided. In particular, the photoreceptor belt 10 is shown in conjunction with the ESS 8, ROS 26, controller 76, sheet registration device 30, transfer station D and fusing station rolls 48, 50—the heated fuser roll 48 and backup roll 50 are shown to provide context for the fuser roll temperature uniformity enhancement system. As can be seen, the ROS unit 26 receives a signal from the ESS and the rotating polygon causes a series of image data to be directed to the previously charged photoreceptive belt 10. As shown in FIG. 2, $I_1$ represents a first portion of image data and $I_2$ represents a second portion of image data located in a laterally offset position from the image data of image $I_1$. This offset is accomplished by utilizing a slight timing differential with respect to the signals sent from the ESS to the ROS imager. Alternatively, an LED light bar imaging system could be used in place of the ROS, in which event the image position transverse to the process direction would be varied across the width of the light bar.

In the example of FIG. 2, as the imaged areas $I_1$ and $I_2$ are advanced further around the belt in the direction of arrow 12, the images will be developed as described above and ultimately transferred to the substrate, represented in FIG. 2 by $S_1$ and $S_2$. $S_1$ corresponds to the position of the sheet that would receive the image data $I_1$ and $S_2$ corresponds to the sheet that would receive the image data $I_2$. Of course it will be recognized that positions $I_1$ and $I_2$ are representative only and many other incremental positions could be achieved.

When the image position is varied by the write source, the substrate position is, in accordance with the presently disclosed embodiment, varied transverse to the paper path direction a corresponding amount so that the image is properly placed on the substrate. A translating roll device 30, including (a) a drive roll 35 and an idler roll 37, both of which cooperate to form a drive nip, and (b) a mechanism 31 to move the drive nip transverse to the paper path direction in response to a signal from the machine controller, could be utilized to align the substrate with the image on the photoreceptor. As described in previously referenced U.S. Pat. No. 5,219,159, a sensor 33 may be positioned to detect when the edge of a sheet passes a certain lateral position. If a stepper motor is utilized to translate the drive nip, the sheet can be accurately positioned a predetermined number of steps to one side or another of the sensor, corresponding to the position of the image on the photoreceptor. Utilizing such an arrangement can allow the position of the images and the substrate to be varied over an area in increments as small as one step of the stepper motor. Further descriptive support regarding the variation of image position (is provided in U.S. Pat. Nos. 5,337,133 and 5,794,176, the pertinent portions of which are incorporated herein by reference.

Figure 3:
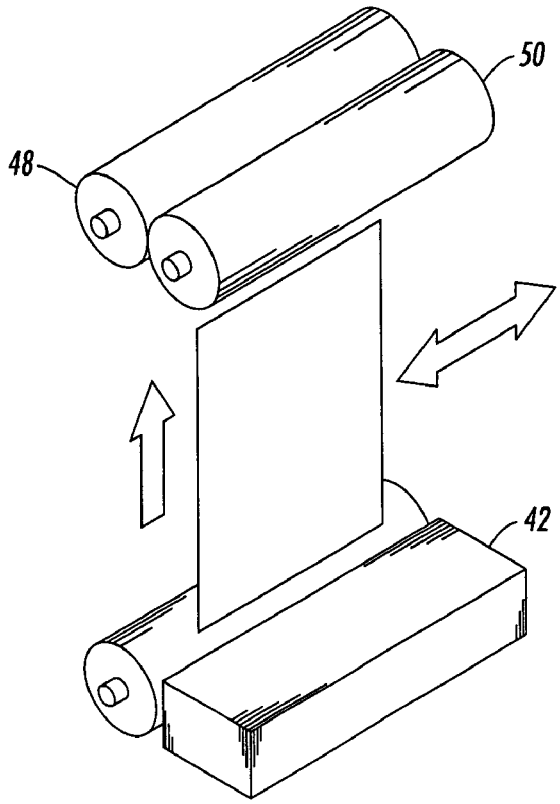
FIG. 3 is a perspective, schematic view of a post-transfer print media sheet shifting system selectively using components and principles of operation similar to those employed for the approach of FIG. 2.

Referring to FIGS. 1 and 3, while the translating roll device 30 is shown as being disposed "upstream" of the transfer station D (FIG. 1), the device 30 could be disposed intermediate of the transfer station D and the fusing station E (Figure), provided a suitable length of print media path exists between the two stations. Note that such suitable length would not necessarily exist in a printing system having a "short [paper] path" between the transfer and the stations (i.e., systems in which transfer of one portion of a sheet and fusing of another part of the sheet occur simultaneously). Also note, referring to FIGS. 2 and 3, that when shifting of print media sheet occurs downstream of the transfer station D, there is no need to offset any of the images I on the photoconductive belt 10.

Figure 4:
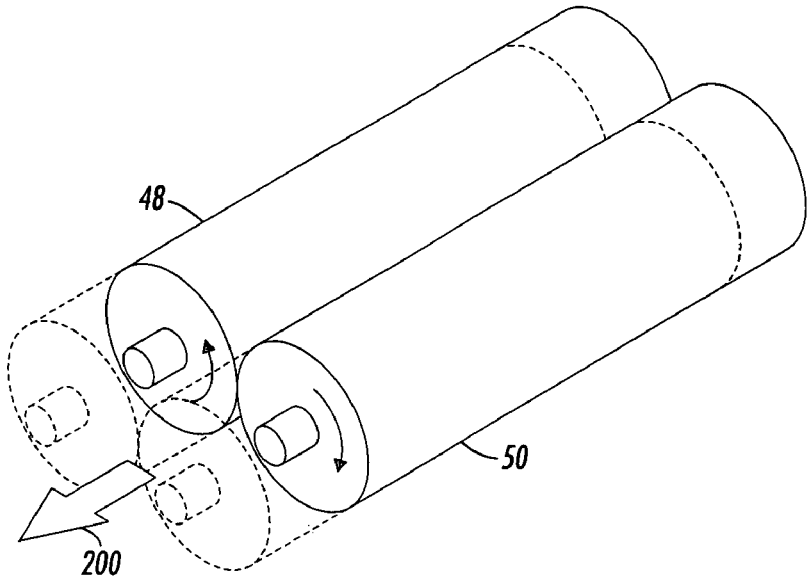
FIG. 4 is a perspective view of a fuser roll and back-up roll being moved simultaneously along a cross process direction.

Referring now to FIG. 4, an alternative approach for changing the position of a print media sheet relative to the rolls 48, 50 is discussed briefly. In the contemplated approach of FIG. 4, the rolls are simultaneously shifted a preselected increment, in the direction of arrow 200, prior to receiving a set of one or more developed print media sheets. In this way, the steps of varying image position relative to the photoreceptor belt 10 (FIG. 2), and shifting print media sheets with translating roll device 30, are unnecessary. An arrangement for shifting rolls 48, 50 are provided in the Xerox iGen3® ("iGen3®" is a trademark of Xerox Corporation) 110 Digital Production Press.

Figure 5:
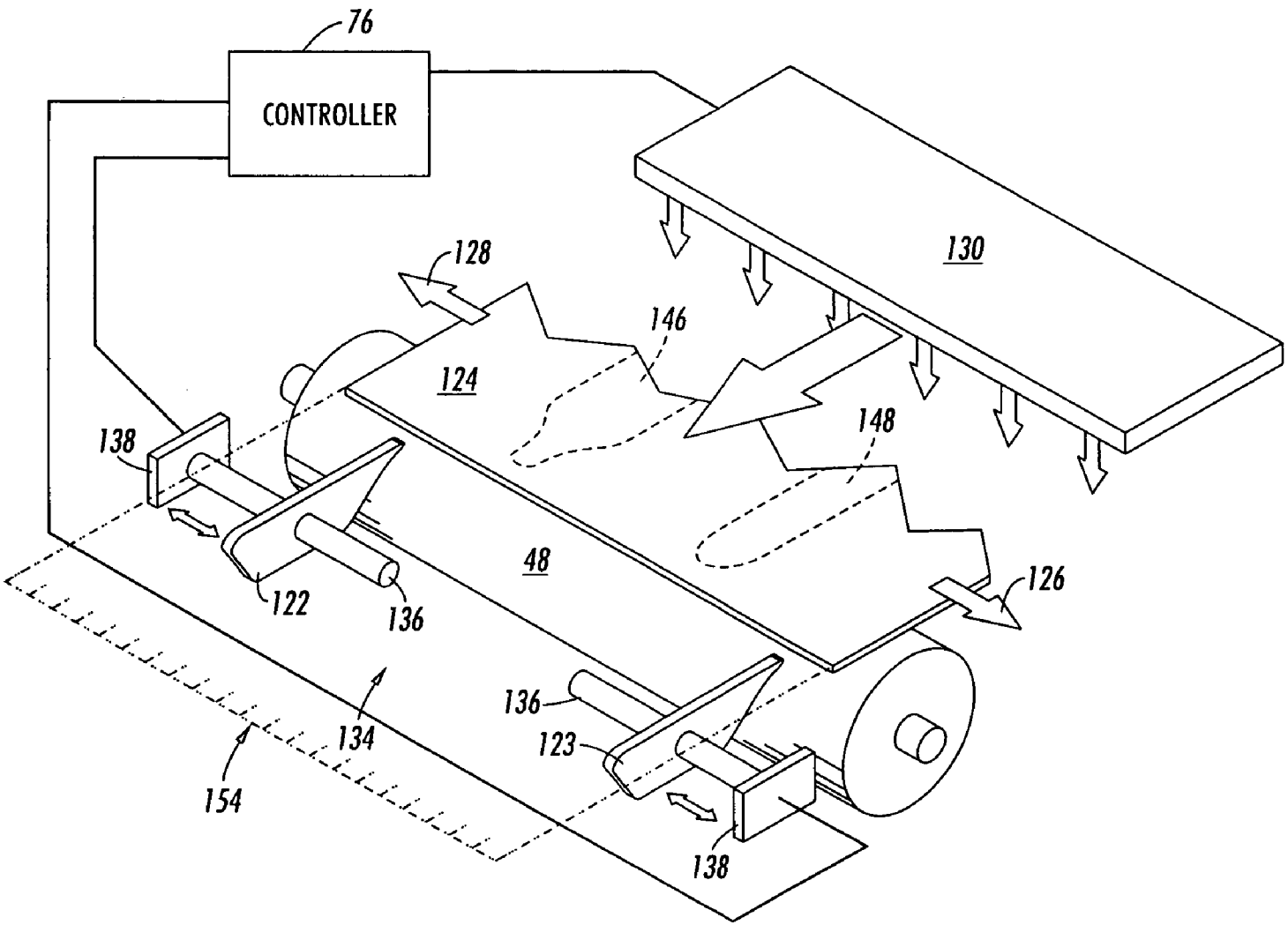
FIG. 5 is a perspective view of some components supporting another embodiment of the fuser stripping subsystem.

Referring to FIG. 5, an overview of a fuser stripping subsystem (with stripping elements or "fingers" 122, 123) in which the stripper fingers are dynamically lubricated, is provided. One or more of the disclosed embodiments of the fuser stripping subsystems may comprise two aspects: In the first aspect, each image to be printed may be analyzed by the system, prior to delivering the corresponding imaged sheet (designated in FIG. 5 by the numeral 124) to the stripper fingers, to determine an inboard/outboard location of the image content—inboard and outboard positions are respectively designated in FIG. 5 by the numerals 126 and 128. In the second aspect, the location of the sheet 124 (with its image (corresponding with a toned image section))—and/or the location of the stripper finger(s)—may be varied inboard or outboard, before the imaged sheet reaches the stripper fingers, in such a way that the best possible overlap occurs between the imaged area(s) and the stripper fingers 122, 123 thereby increasing the chances that the stripper fingers will get suitably lubricated by the toner.

Referring still to FIG. 5, a general description of to the disclosed embodiments will now be provided. In part, the disclosed embodiments permit dynamic adjustment of the relative inboard/outboard location of the stripper fingers and imaged areas with respect to the sheet passing through the fuser so that, in accordance with an algorithm discussed below, a "maximum" overlap occurs between the imaged areas and the stripper finger(s) in the fuser. It is believed that in "traditional" xerographic printing systems this was not generally possible because no facility was typically provided for moving the image, the sheet, and/or the stripper fingers relative to each other in the inboard/outboard direction.

As contemplated by at the disclosed embodiments, the locations of the imaged areas of the image are determined prior to imaging. One way to do this would be to utilize a sensor 130 (FIG. 5), such as a full-width array sensor to detect the inboard/outboard location of the imaged areas. This sensing could be done either before or after the image was transferred to the paper, but it would obviously have to be done before the imaged sheet reached the stripper fingers. In a digital system, a more efficient and inexpensive way to determine image location would be to employ an image processing algorithm ("image locating algorithm") that acts upon a stored image file to make the determination. The framework of this image locating algorithm will be provided below.

In the second aspect of the disclosed embodiments (where the relative inboard (IB)/outboard (OB) location of the imaged areas is changed relative to the stripper fingers) the image locating algorithm would be employed determine the ideal relative IB/OB location of the imaged areas to the stripper fingers, subject to the constraints of the system (for instance, how far the image, the sheet, and/or the fingers could be moved). Pursuant to the disclosed embodiments, the image locating algorithm can be used to address the following three approaches:

1) Consistent with the discussion above, with respect to FIG. 2, the actual location of the image is moved IB or OB, for instance by shifting where the image is laid down on the photoreceptor, and the IB/OB location of the paper (before transfer) would be adjusted to meet this varying image location in transfer. This could be done utilizing an active registration system of the type disclosed in the above-incorporated patents. In this way, when the sheet arrives at the stripper fingers, it is shifted IB or OB relative to the location of the fingers.
2) The IB/OB location of the image and the sheet is held fixed in its "normal" position through transfer. Then, after transfer and before the sheet reaches the stripper fingers, the sheet (with its toned image) is moved IB or OB. As mentioned above, this approach would be unfeasible in systems having a "short [paper] path."
3) The IB/OB location of the image and the sheet is held fixed in its "normal" position all the way through the fuser. However, the IB/OB location of the stripper fingers is moved. Note that this could be done all at one time (i.e., all the fingers could be moved together (possibly as a unitary assembly)) or the stripper fingers could be moved independently.

Each of these three approaches (which could be used in combination) will be described in further detail with respect to the discussion of FIGS. 6 and 7.

As just indicated above, the third approach might be implemented with a movable or translatable stripper assembly 134 (FIG. 5), including the stripper fingers 122 mounted to shafts 136. The shafts might be mounted to drives 138, with the drives being controlled by the controller 76. Since each stripper finger of FIG. 5 (along with its associated shaft) is mounted independently to a drive, the respective positions of the stripper fingers can be independently adjusted. It will be appreciated, by those of skill in the art, that use of more than two stripper fingers would be consistent with the present disclosure, and that the drive mechanism (including the drives 138 communicating with controller 76) could be implemented by reference to the teachings of the above-incorporated U.S. Pat. Nos. 5,337,133 and 5,794,176. Moreover, as will appear, all of the stripper fingers could be mounted to a unitary movable base actually simplifying the principles of operation upon which the disclosed embodiments are based.

Figure 6:
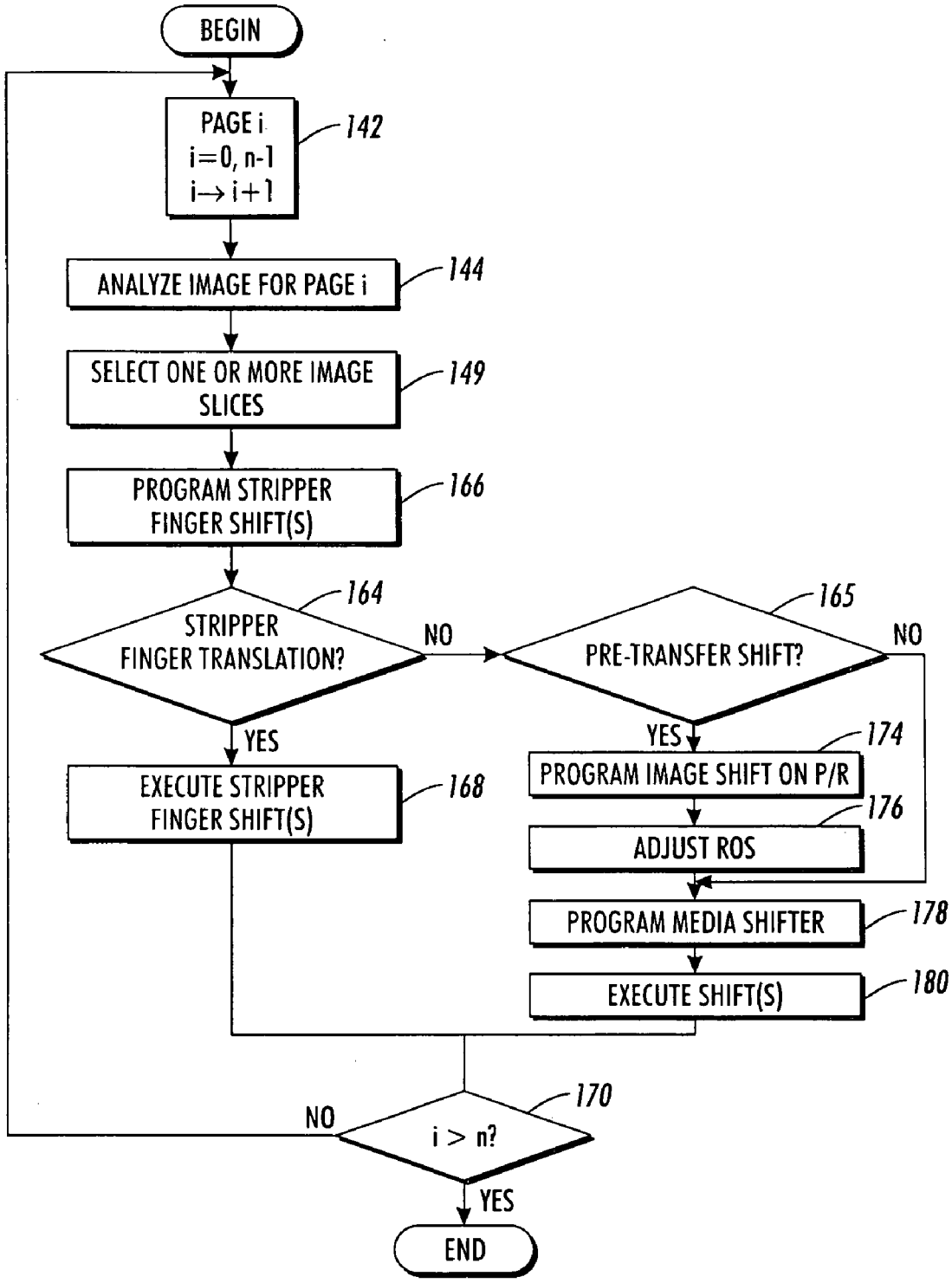
FIG. 6 is a flow chart demonstrating some of the functionality associated with the operation of the fuser stripping subsystem.

Before proceeding to FIG. 6 and a corresponding description of some of the functional framework supporting the disclosed embodiments of the fuser stripping subsystem (including the framework of the algorithm), an overview of the above-mentioned algorithm is provided. One possible algorithm functions in the following manner: First, as shown in FIG. 7, an image file for a given image could be "sliced up" into strips parallel to the process direction. In one example, the width of the strips is roughly the same as that of the stripper fingers. Second, the number of pixels in each strip would then be added up. Third, the total number of pixels in the strips that line up with the stripper fingers—assuming no relative translation (i.e. with the default, "normal" finger-to-image alignment)—would be added up. Fourth, the corresponding pixel tally for the strips lining up with the stripper fingers for all possible relative translations between the fingers and the image (where "all possible" means subject to the constraints of the system and probably with an assumed "reasonable" increment for any given translation, say some small number of millimeters) would be determined. Finally, the translation with the highest tally would be selected and utilized for the given image (noting that, in some instances, the highest tally might be one requiring no translation at all).

Referring now to FIG. 6, an exemplary routine for implementing some of the disclosed embodiments (and further describing the above-mentioned algorithm) is provided. The routine of FIG. 6 is begun each time a print or copy job ("job") is received for processing. Job processing is conventional and a detailed description of a system for rasterizing a job from an electronic document is provided in U.S. Pat. No. 5,493,634 to Bonk et al., the pertinent portions of which are incorporated herein by reference. At 142, the variable "i" is assigned to a job of n rasterized electronic pages and the range of i is set for 1 to n. At 144, the image of an $i^{th}$ page ("page i"), as shown, for example, in FIG. 7, is examined to determine where toned image portions are to be disposed on page i. This can be done in one of several ways. In one example, the bitmap associated with the image is stored in short term memory, the short term memory (not shown) possibly being associated with ESS 8 (FIG. 1). The bitmap can be scanned to determine the locations of the image areas associated with the various pixel types, and that information stored for future reference by the controller 76. With a monochrome image, for instance, the respective positions (or coordinates) of the black pixels and colorless pixels would be stored; with a color image, the number of pixel types would exceed two.

Figure 7:
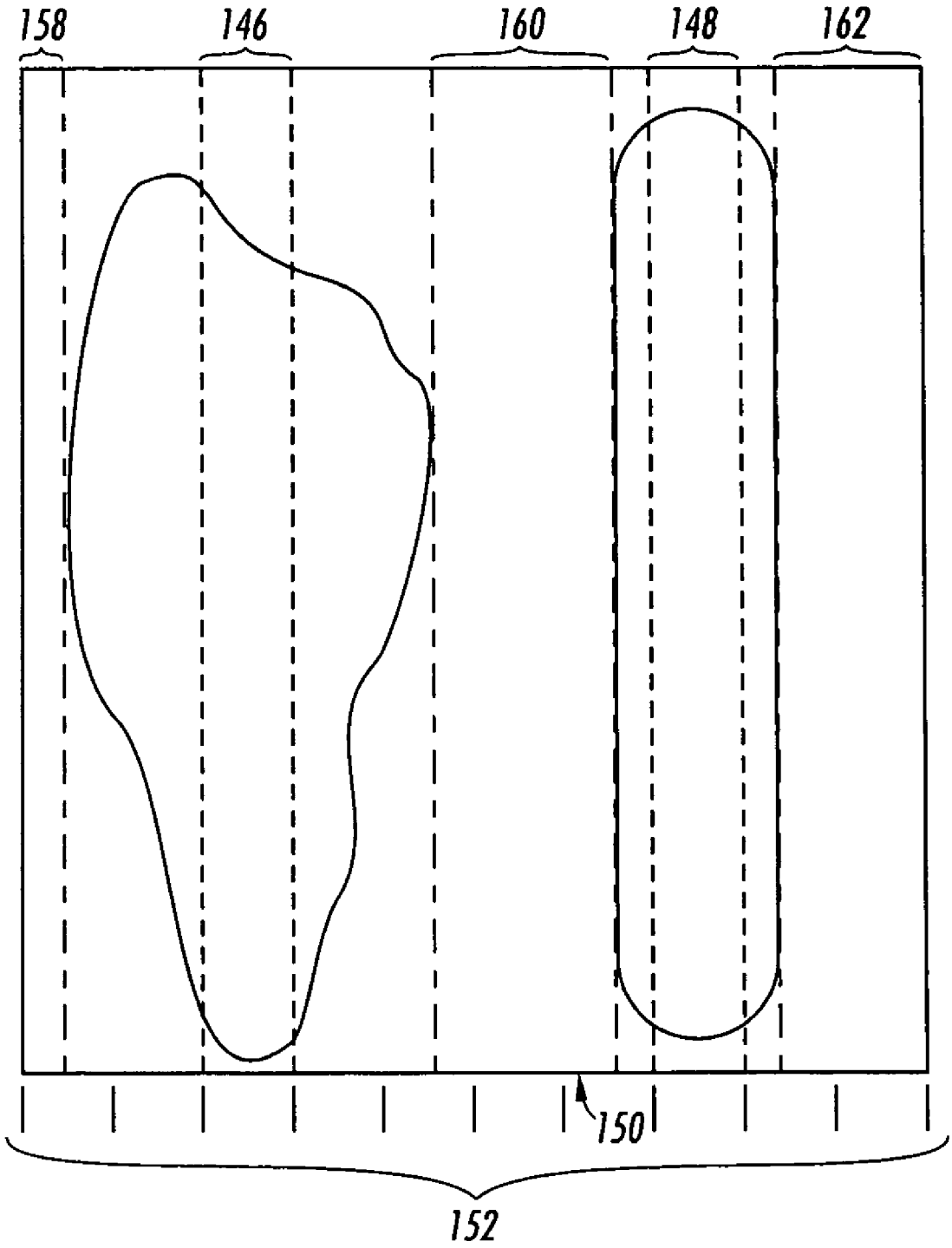
FIG. 7 is a planar view of a bit map corresponding with a print media sheet upon which two toned image sections are disposed.

Referring specifically to FIGS. 6 and 7, knowing the pixel positions of the image areas permits image strips of consecutive black (or other colored) pixels 146, 148 to be selected per 149. Identifying these image strips can be readily achieved with a variety of conventional pixel assessing systems. One system suitable for analyzing the locations of pixel strings (run lengths of consecutive pixels of the same color) is disclosed in U.S. Pat. No. 6,738,518 to Minka et al., the pertinent portions of which are incorporated herein by reference.

In the presently discussed example, the two strips correspond with the print media sheet 124 (FIG. 5) which, in turn, is stripped by stripper fingers 122 and 123. In other contemplated systems, there could be more than two stripper fingers and hence more than two identified image strips. In the example of FIG. 7, the image strips are selected to obtain the longest lines of contiguous black pixels possible. Also, the respective positions of the image strips can be identified, relative to a feed edge 150 (FIGS. 5 and 7) by way of a suitable feed edge grid 152. As will appear, the feed edge grid 152 can be used in conjunction with a stripper finger grid 154 (FIG. 5) to determine how the print media sheet (with the image strips) should be aligned relative to the stripper fingers 122, 123.

In another embodiment, the image strips could be designated indirectly by identifying areas without black or colored pixels, such as areas 158, 160 and 162. As will appear, with this knowledge the stripper fingers or the print media sheet could be positioned so that the stripper fingers avoid the white or non-toned sections of the image, and thus obtain at least some toner lubricant. Referring still to FIGS. 5 and 7, in yet another embodiment, the respective locations of image strips 146, 148 could be identified with the sensor 130.

Referring to FIGS. 5-7, pursuant to paths defined by 164 and 165, determinations as to the amount of image shift (relative to the stripper fingers 122, 123) are made. In one approach, the controller is used to compare the relative positions of the stripper fingers 122, 123 (using grid 154) to the relative positions of the image strips 146, 148. As alluded to above, an image may be shifted relative to one or more stationary stripper fingers, or a set of stripper fingers may be shifted relative to one or more image strips.

Referring still to FIGS. 5-7, at 164 the system determines whether stripper finger translation is feasible and/or necessary. Stripper finger translation is feasible if the stripper fingers 122, 123 can be positioned relative to the image strips without exceeding the IB, OB, and/or internal constraints of the fuser assembly 46. Also, a stripper finger, such as stripper finger 123, may not require translation because it is already suitably aligned with image strip 148.

Assuming all IB, OB, and internal constraints can be met, at 166, one or more stripper finger shifts are programmed. In one approach, where each stripper finger is independently movable (FIG. 5), the amount of stripper finger movement required to optimally align each stripper finger with an image strip is determined and then programmed. Alternatively, where the stripper fingers are part of a unitary assembly, the amount of movement to required to optimize a positional relationship between the stripper fingers and various image strips would be determined and programmed. As will be appreciated, the algorithm employed in determining a single shift distance for a unitary set of stripper fingers would behave somewhat differently than an algorithm designed to determine respective shifts for independently movable fingers (due to, among other things, the difference of certain constraints).

Responsive to the programming, stripper finger shift(s) may be executed with drive mechanisms 168. As should be appreciated, when one or more stripper fingers are shifted, there is no need to shift the image, as indicated below. After executing the stripper finger shift, a check is made at 170. If $i \leqq n$, then the system returns back to step 142 to process another image; otherwise, the routine ends, at which point the moved fingers may either be left where they are or returned to their home, "normal" position(s)

Referring still to FIGS. 5 and 6, if stripper finger translation movement is not possible or feasible, then the routine may default to an image shift. At 165, a determination is made as to whether the print media sheet is to be shifted before or after transfer. If pre-transfer shift is to occur, then, at 174, the amount of latent image shift required on the photoreceptor (FIG. 2) to bring as many image strips into alignment with stationary stripper fingers as possible is determined and programmed. Responsive to the programming of 174, suitable adjustments are made with the controller 76 (for ROS control) at 176 so, as described above, the image will appropriately align with the shifted print media sheet as the image is transferred to the shifted print media sheet. For either pre-transfer or post-transfer shifting operation, a shift distance may be stored by the controller 76 (at 178) for use with the edge registration device 30, if necessary. Assuming that at least one ROS adjustment and/or at least one media shift distance has been stored, then a shift will be executed (at 180), with the print media sheet being nudged by the edge registration device. As should be appreciated, the principles of edge registration device nudging are the same for the shifting devices of FIGS. 2 and 3. At 170, if $i \leqq n$, then the system returns back to step 142 to process another image; otherwise, the routine ends.

Based on the above description, the following features of a first aspect of the disclosed embodiments should now be apparent:

At least one stripper finger may be translated from a first position to a second position. A bitmap corresponding with a print media sheet having a toned image is stored in memory. The bitmap might include image information usable by a controller in determining a location of the second position. Also, location information corresponding with the first position may be provided. In turn, the controller can use the location information and the image information to determine the first and second positions, respectively. In practice, a portion of the bitmap may be corresponded with a toned image section. In one example, the toned image section relative to the page corresponds with a first set of coordinates and the location of the at least one stripper finger corresponds with a second set of coordinates, wherein the controller uses the first and second sets of coordinates to determine said distance.

In one example, an image sensing device may be disposed relative to a print media sheet path for obtaining information regarding the location of the toned image section to said controller.

In another example, the toned image section comprises a line of multiple contiguous pixels positioned in substantial alignment with the at least one stripper finger.

In yet another example, each pixel corresponds with either a color or no color, and all of the multiple contiguous pixels correspond with either the color or no color.

In yet another example, the fuser stripping subsystem includes: (1) first and second movable stripping assemblies, and (2) first and second drive mechanisms. The second movable stripping assembly may be selectively positioned adjacent one of the fuser roll and back-up roll, the second movable stripping assembly may include at least one stripper finger, and the at least one stripper finger of the second movable stripping assembly may be disposed in a third position for causing a second portion of a print media sheet, having a second toned image section disposed thereon, to be stripped from one of the fuser roll or back-up roll as the print media sheet with the first and second toned image sections passes through the nip. Additionally, the second drive mechanism is operatively coupled with the second movable stripping assembly for causing the second movable stripping assembly to be moved from the third position to a fourth position when a second selected condition is met—the fourth position corresponds substantially with a location of the second toned image section, relative to the second movable stripping assembly, as the print media sheet passes through the nip. In practice, the controller communicates with the second drive mechanism, and (a) obtains information regarding the location of the second toned image section (b) determines a shift distance between the third position and the fourth position, and (c) causes the second drive mechanism, with the shift distance between the third and fourth positions, to move the second movable stripping assembly from the third position to the fourth position when the second selected condition is met so that the at least one stripper finger of the second movable stripping assembly is substantially aligned with the second toned image section before the lead edge of the print media sheet arrives at the second movable stripping assembly.

As contemplated the first aspect of the disclosed embodiments may depend on a selected condition that is met if, (1) moving a translatable or movable stripping assembly from the first position to the second position does not cause movable stripping assembly to move substantially outside of a fixed space, or (2) the controller determines that a shift distance between the first position and the second position is substantially greater than zero.

Based on the above description, the following functions of a second aspect of the disclosed embodiments should now be apparent:

In one example, a print media sheet with a toned image is shifted relative to at least one of a set of stripper fingers. The shifting may include: (1) shifting a latent image on the photoreceptive member, (2) applying toner to the latent image to obtain a shifted toned image, (3) shifting the print media sheet; and, (4) transferring the shifted toned image to the shifted print media sheet.

In another example the print media sheet with the toned image is shifted relative to the at least one stripper finger after the toned image has been transferred to the print media sheet.

In yet another example, the print media sheet with the toned image is shifted, relative to the at least one stripper finger, by moving both the fuser roll and the back-up roll.

In yet another example, a positional relationship is determined between at least one of the set of stripper fingers and the image information on an electronic page. A set of contiguous pixels is disposed on the electronic page and the determining of the positional relationship includes comparing the position of the contiguous pixels on the electronic page with the position of the at least one of the set of stripper fingers.

In another example, the electronic page includes pixels corresponding with a color and pixels corresponding with no color, and said determining a positional relationship includes using the pixels corresponding with no color as the image information.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A fuser stripping method for use with a fusing system having a fuser roll and a back-up roll positioned to form a nip, comprising:

(A) determining whether said method is to be performed in one of a first mode and a second mode;

(B) performing the following when it is determined, with said (A), that said method is to be performed in said first mode:

(1) providing a movable stripping assembly selectively positioned adjacent one of the fuser roll and back-up roll, said movable stripping assembly including at least one stripper finger for causing a print media sheet, having a toned image section disposed thereon, to be stripped from one of the fuser roll or back-up roll as the print media sheet with the toned image section passes through the nip, (2) selectively positioning the at least one stripper finger in a first position, (3) determining a shift distance between the first position and a second position, the second position corresponding substantially with a location of the toned image section as the print media sheet passes through the nip, and (4) if a selected condition is met, moving the movable stripping assembly from the first position to the second position so that the at least one stripper finger is aligned with the toned image section; and (C) performing the following when it is determined, with said (A), that said method is to be performed in said second mode:

(1) storing an electronic document including an electronic page, the electronic page corresponding with the print media sheet and including image information corresponding with the toned image section, (2) prior to imaging the print media sheet with the image information, determining a positional relationship between at least one of the set of stripper fingers and the image information on the electronic page, (3) when the positional relationship varies from an accepted positional relationship by a selected amount, determining an amount of print media sheet shift required to obtain the positional relationship, and (4) shifting the print media sheet with the at least one toned image section relative to the set of stripper fingers, said shifting causing the toned image section to be positioned in substantial alignment with the at least one of the set of stripper fingers as the print media sheet is fed through the nip so that the at least one of the set of stripper fingers is lubricated by contact with the at least one toned image section.

2. The method of claim 1, in which the movable stripping assembly is movable within a fixed space, wherein said (B)(4) includes determining whether the movable stripping assembly can be moved from the first position to the second position without moving the movable stripping assembly substantially outside of the fixed space.

3. The method of claim 1, wherein said (B) further comprises:

storing a bitmap corresponding with the print media sheet, said bitmap including image information;

storing a location corresponding with the first position; and using the location information and the image information to determine the first and second positions, respectively.

4. A fuser stripping subsystem for use with a fusing system having a fuser roll and a back-up roll positioned to form a nip, comprising:

a movable stripping assembly selectively positioned adjacent one of the fuser roll and back-up roll, said movable stripping assembly including at least one stripper finger, the at least one stripper finger being disposed in a first position and causing a portion of a print media sheet, having a lead edge and a toned image section disposed thereon, to be stripped from one of the fuser roll or back-up roll as the print media sheet with the toned image section passes through the nip;

a drive mechanism, operatively coupled with said movable stripping assembly, for causing said movable stripping assembly to be moved from the first position to a second position when a selected condition is met, wherein the second position corresponds substantially with a location of the toned image section, relative to said movable stripping assembly, as the print media sheet passes through the nip; and a controller communicating with said drive mechanism, said controller (a) obtaining information regarding the location of the toned image section (b) determining a shift distance between the first position and the second position, and (c) causing said drive mechanism, with said shift distance, to move said movable stripping assembly from the first position to the second position when the selected condition is met so that the at least one stripper finger is substantially aligned with the toned image section before the lead edge of the print media sheet arrives at said movable stripping assembly.

5. The fusing stripping subsystem of claim 4, further comprising:

a memory for storing (a) a bitmap corresponding with the print media sheet, said bitmap including image information usable by said controller in determining a location of the second position, and (b) location information corresponding with the first position, wherein said controller uses the location information and the image information to obtain the first and second positions, respectively.

6. The fusing stripping subsystem of claim 5, in which the toned image section relative to the page corresponds with a first set of coordinates and the location of the at least stripper finger corresponds with a second set of coordinates, wherein said controller uses the first and second sets of coordinates to determine said distance.

7. The fusing stripping subsystem of claim 4, in which the print media sheet is directed to the fusing system along a print media sheet path, further comprising an image sensing device disposed relative to the print media sheet path for obtaining the information regarding the location of the toned image section to said controller.

8. The fusing stripping subsystem of claim 4, wherein the toned image section comprises a line of multiple contiguous pixels, and wherein the line of multiple contiguous pixels are positioned in substantial alignment with said at least stripper finger.

9. The fusing stripping subsystem of claim 8, in which each pixel corresponds with either a color or no color, wherein all of the multiple contiguous pixels correspond with either the color or no color.

10. The fusing stripping subsystem of claim 4, wherein the selected condition is met when said controller determines that the shift distance is substantially greater than zero.

11. The fusing stripping subsystem of claim 4, in which said movable stripping assembly is movable within a fixed space, wherein the selected condition is met if moving said movable stripping assembly from the first position to the second position does not cause said movable stripping assembly to move substantially outside of said fixed space.

12. The fuser stripping subsystem of claim 4, in which said movable stripping assembly comprises a first movable stripping assembly, said drive mechanism comprises a first drive mechanism, the portion of the print media sheet comprises a first portion of the print media sheet with a first toned image section, and the selected condition comprises a first selected condition, further comprising:

a second movable stripping assembly selectively positioned adjacent one of the fuser roll and back-up roll, said second movable stripping assembly including at least one stripper finger, the at least one stripper finger of said second movable stripping assembly being disposed in a third position and causing a second portion of a print media sheet, having a second toned image section disposed thereon, to be stripped from the one of the fuser roll or back-up roll as the print media sheet with the first and second toned image sections passes through the nip;

a second drive mechanism, operatively coupled with said second movable stripping assembly, for causing said second movable stripping assembly to be moved from the third position to a fourth position when a second selected condition is met, wherein the fourth position corresponds substantially with a location of the second toned image section, relative to said second movable stripping assembly, as the print media sheet passes through the nip; and wherein said controller communicates with said second drive mechanism, and (a) obtains information regarding the location of the second toned image section (b) determines a shift distance between the third position and the fourth position, and (c) causes said second drive mechanism, with said shift distance between the third and fourth positions, to move said second movable stripping assembly from the third position to the fourth position when the second selected condition is met so that the at least one stripper finger of the second movable stripping assembly is substantially aligned with the second toned image section before the lead edge of the print media sheet arrives at said second movable stripping assembly.

13. A fuser stripping method for use with a fusing system having a fuser roll and a back-up roll positioned to form a nip, comprising:

providing a movable stripping assembly selectively positioned adjacent one of the fuser roll and back-up roll, said movable stripping assembly including at least one stripper finger for causing a print media sheet, having a toned image section disposed thereon, to be stripped from one of the fuser roll or back-up roll as the print media sheet with the toned image section passes through the nip;

selectively positioning the at least one stripper finger in a first position;

determining a shift distance between the first position and a second position, the second position corresponding substantially with a location of the toned image section as the print media sheet passes through the nip; and moving the movable stripping assembly from the first position to the second position when a selected condition is met so that the at least one stripper finger is substantially aligned with the toned image section.

14. The method of claim 13, further comprising:

storing a bitmap corresponding with the print media sheet having the toned image section, said bitmap including image information;

storing a location corresponding with the first position; and using the location information and the image information to obtain the first and second positions, respectively.

15. The method of claim 14, further comprising designating a portion of the bitmap as corresponding with the toned image section.

16. The method of claim 15, wherein said designating includes selecting a line of contiguously disposed pixels.

17. A method of reducing wear in a fusing system including a fuser roll and a back-up roll positioned to form a nip, the fusing system being positioned adjacent a set of stripper fingers, comprising:

storing an electronic document including an electronic page, the electronic page corresponding with a print media sheet and including image information corresponding with at least one toned image section to be toned on the print media sheet;

prior to imaging the print media sheet with the image information, determining a positional relationship between at least one of the set of stripper fingers and the image information on the electronic page;

when the positional relationship varies from an accepted positional relationship by a selected amount, determining an amount of print media sheet shift required to obtain the positional relationship; and shifting the print media sheet with the at least one toned image section relative to the set of stripper fingers, said shifting causing the toned image section to be substantially aligned with at least one of the set of stripper fingers as the print media sheet is fed through the nip wherein the at least one of the set of stripper fingers is lubricated by contact with the at least one toned image section.

18. The method of claim 17, in which a photoreceptive member is provided, wherein said shifting comprises:

shifting a latent image on the photoreceptive member;

applying toner to the latent image to obtain a shifted toned image;

shifting the print media sheet; and transferring the shifted toned image to the shifted print media sheet.

19. The method of claim 17, in which a toned image is transferred to the print media sheet, wherein said shifting includes shifting the print media sheet with the toned image after the toned image has been transferred to the print media sheet.

20. The method of claim 17, wherein said shifting includes achieving said shifting by moving both the fuser roll and the back-up roll.

21. The method of claim 17, in which (a) a bitmap including the image information is stored in memory, (b) the image information includes at least one set of contiguous pixels, (c) the contiguous pixels correspond with a position on the electronic page, and (d) the at least one of the set of stripper fingers corresponds with a position relative to the fusing system, wherein said determining a positional relationship includes comparing the position of the contiguous pixels on the electronic page with the position of the at least one of the set of stripper fingers.

22. The method of claim 17, in which the electronic page includes pixels corresponding with a color and pixels corresponding with a lack of color, wherein said determining a positional relationship includes using the pixels corresponding with a lack of color as the image information.

* * * * *